United States Patent [19]

Morris

[11] 4,071,091

[45] Jan. 31, 1978

[54] MOTOR GRADER WITH DETACHABLE LINK FOR REDUCED BLADE ANGLE OPERATION

[75] Inventor: Carlisle S. Morris, Decatur, Ill.

[73] Assignee: Caterpillar Tractor Co., Peoria, Ill.

[21] Appl. No.: 697,903

[22] Filed: June 21, 1976

[51] Int. Cl.[2] ..... E02F 3/76

[52] U.S. Cl. ..... 172/797; 92/13.41

[58] Field of Search ..... 172/781, 782, 789, 791, 172/792, 793, 795, 796, 797; 92/13.4, 13.41, 13.5, 118, 161; 52/726; 285/12, 31; 403/337

[56] References Cited

U.S. PATENT DOCUMENTS

| | | | |
|---|---|---|---|
| 2,976,844 | 3/1961 | Goldring | 92/13.41 |
| 3,168,014 | 2/1965 | Aslan | 92/161 X |
| 3,548,955 | 12/1970 | Hart | 172/793 |
| 3,550,692 | 12/1970 | Hart | 172/793 |
| 3,739,861 | 6/1973 | Johnson et al. | 172/793 |

*Primary Examiner*—Richard T. Stouffer
*Attorney, Agent, or Firm*—Phillips, Moore, Weissenberger, Lempio & Majestic

[57] ABSTRACT

The invention is concerned with an improvement in a motor grader which comprises a powered vehicle having a main grader frame extending forwardly therefrom, the frame being supported adjacent its forwardmost end by ground engaging wheels, a circle drawbar mounted below the frame intermediate a power unit for the vehicle and the ground engaging wheels, a circle member mounted below the circle drawbar, gear wheels for rotating the circle member relative to the circle drawbar, a blade mounted to the circle member and therebelow, a first hydraulic cylinder rotatably mounted at a first end thereof adjacent the frame and at a second end thereof adjacent a periphery of the circle drawbar, and a pair of second hydraulic cylinders rotatably mounted adjacent a first end thereof adjacent the periphery of the drawbar and adjacent a second end thereof adjacent the frame. The improvement of the invention allows operation of the motor grader at a reduced bank cut angle of the blade to a surface being graded. The improvement comprises a replaceable link attachable in line with the first cylinder to extend the length thereof, the link being removable to allow the blade to be rotated beneath the frame from a first side of the motor grader to a second side thereof.

10 Claims, 5 Drawing Figures

MOTOR GRADER WITH DETACHABLE LINK FOR REDUCED BLADE ANGLE OPERATION

BACKGROUND OF THE INVENTION

Field of the Invention

The invention is concerned with the motor grader art. More particularly, the invention is concerned with an improvement in a motor grader of the type having a power unit and a frame pivotally extending forwardly therefrom with the forwardmost end of the frame being supported by wheels. A blade is supported beneath the frame in such a motor grader and is tiltable relative to the frame to provide different angles for cutting into a bank. The present invention is particularly concerned with an improvement which allows the bank to be cut at a lower angle than with previous motor graders without losing the ability for cutting a bank at a higher angle or moving the blade beneath the frame from one side thereof to the other to allow cutting of a bank on an opposite side of the motor grader.

Prior Art

The prior art teaches motor graders which comprise powered vehicles having a main grader frame extending forwardly therefrom, with the frame being supported adjacent its forwardmost end by ground engaging means such as wheels. A circle drawbar is also known to the prior art which is mounted below the frame intermediate the vehicle and the ground engaging means. A circle member is generally mounted below and to the circle drawbar, and gear means are provided for rotating a circle member relative to the circle drawbar. The blade is mounted to the circle member and therebelow. It is known to make use of a first hydraulic cylinder rotatably mounted at a first end thereof adjacent the frame and at a second end thereof adjacent the periphery of the circle drawbar and a pair of second hydraulic cylinders each rotatably mounted adjacent a first end thereof adjacent the periphery of the circle drawbar and adjacent the second end thereof adjacent the frame. With such an apparatus, it is possible to cut banks on either side of the frame by proper manipulation of the first and second hydraulic cylinder means and the gear means whereby the blade can be rotated beneath the vehicle and tilted upwardly at its outer edge on either side of the frame which extends forwardly from the vehicle. The frame is attached to a power unit of the vehicle generally via an articulated joint and the wheels attached to the forwardmost end of the frame can be tilted relative to the wheels of the power unit of the vehicle so as to provide maneuverability whereby the wheels on the forwardmost end of the frame can be offset latitudinally from the wheels of the vehicle by a desired distance and can be tilted at an angle relative thereto. This allows, for example, the cutting of curved banks.

The angle of the blade relative to the ground over which it is being run can be varied in the prior art vehicles only within a single range as determined by the length and stroke of the first cylinder. Further, in the prior art vehicles the total length of the first cylinder with the rod retracted is limited since it is necessary that it be sufficiently short so that the blade can be rotated beneath the frame from a first side of the frame to a second side thereof. Thus, a relatively limited range of bank angles can be cut using prior art motor graders.

The present invention is concerned with an improvement which allows a prior art motor grader to be used to cut banks of a reduced angle relative to the ground upon which the grader is being run. The improvement of the present invention in particular allows this reduced angle to be accomplished on the side of the frame adjacent that which the first cylinder is attached.

SUMMARY OF THE INVENTION

The invention is concerned with an improvement in a motor grader which comprises a powered vehicle having a main grader frame extending forwardly therefrom and being supported adjacent its forwardmost end by ground engaging means, a circle drawbar mounted below said frame intermediate said vehicle and said ground engaging means, a circle member mounted below said circle drawbar, gear means for rotating said circle member relative to said circle drawbar, a blade mounted to said circle member and therebelow, first hydraulic cylinder means rotatably mounted at a first end thereof adjacent said frame and a second end thereof adjacent a periphery of said circle drawbar and a second hydraulic cylinder means rotatably mounted adjacent a first end thereof adjacent the periphery of said circle drawbar and adjacent a second end thereof adjacent said frame. The improvement of the invention allows operation of the motor grader at a range of angles of said blade relative to a surface being graded which is reduced from the range of angles at which the motor grader can normally be operated without said improvement. The improvement comprises a replaceable link attachable in line with the first cylinder means to extend the length thereof, the link being removable to allow the blade to be rotated beneath the frame from a first side thereof to a second side thereof.

BRIEF DESCRIPTION OF THE DRAWINGS

The invention will be better understood by reference to the figures of the drawings wherein like numbers denote like parts throughout and wherein.

DETAILED DESCRIPTION OF THE PREFERRED EMBODIMENTS

Figure 1:
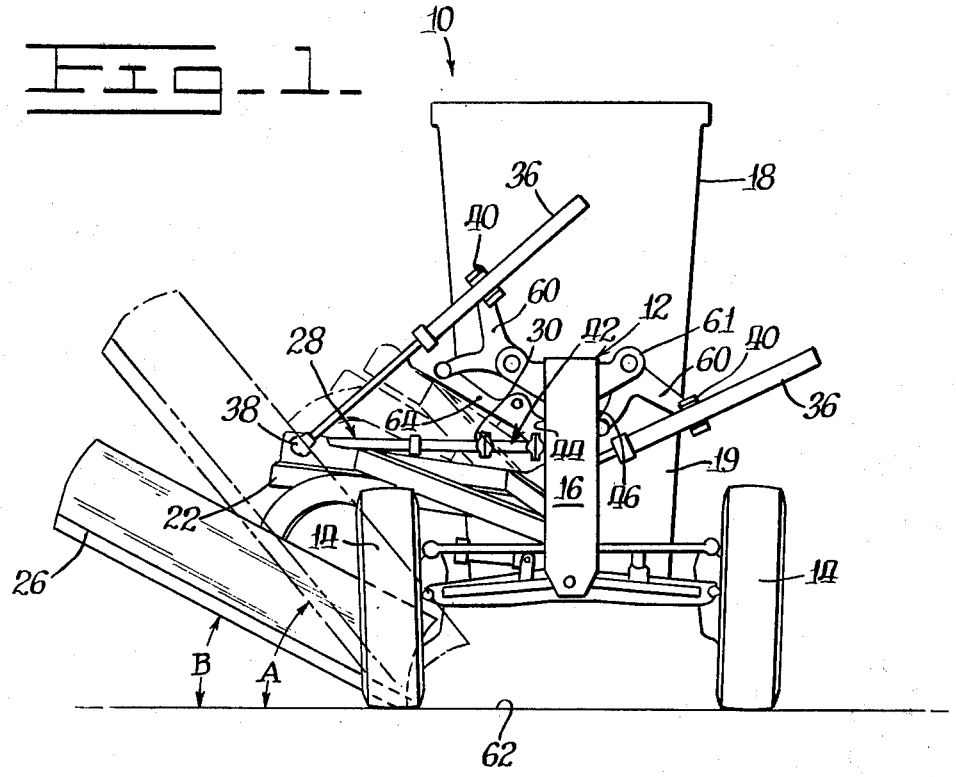
FIG. 1 illustrates a front view of the motor grader having the improvement of the present invention included as a part thereof, and further illustrates, in phantom, the adjustment of a motor grader blade obtainable with the prior art motor graders.
Figure 2:
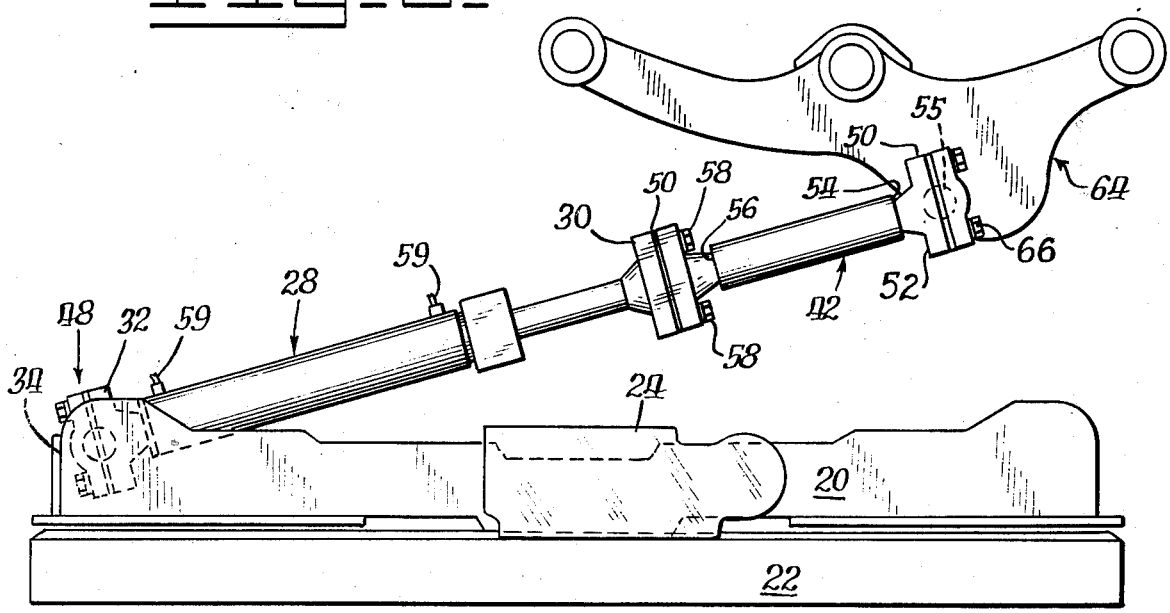
FIG. 2 illustrates the improvement of the present invention in greater detail.

FIG. 1 illustrates a motor grader 10 having a frame 12 extending forwardly therefrom to ground engaging means, namely a pair of wheels 14 which, as will be seen, extend from a forwardmost end 16 of the frame 12. The frame 12 has a cab 18 at the rearmost end thereof, which cab 18 is attached at the frontmost end thereof in a conventional articulated manner to a power unit 19 of the motor grader 10. A circle drawbar 20, seen most easily in FIG. 2, is mounted below the frame intermediate the cab 18 and the wheels 14. A circle member 22 is mounted below the circle drawbar 20. Gear means within a gear housing 24 on the circle drawbar 20 serve for rotating the circle member 22 relative to the circle drawbar 20. A blade 26 is mounted to the circle member 22 below it. In the embodiment illustrated, first hydraulic cylinder means 28 is rotatably mounted at a first end 30 thereof adjacent the frame 12 and at a second end 32 thereof rotatably mounted adjacent the periphery 34 of the circle drawbar 20. A pair of second hydraulic cylinder means 36, in the embodiment illustrated, are rotatably mounted adjacent a first end 38 thereof adjacent the periphery 34 of the circle drawbar 20, and adjacent a second end 40 thereof adjacent the main frame 12.

A replaceable link 42, as seen most clearly in FIG. 2, is attachable in line with the first hydraulic cylinder 28 to longitudinally extend it. The link 42 is removable to allow the blade 26 to be rotated beneath the frame 12 from a first side 44 thereof to a second side 46 thereof. As will be most clear from FIG. 2, the first hydraulic cylinder 28 is universally mounted at the first and second ends 30 and 32 thereof, respectively, to the frame 12 and the circle drawbar 20. This universal mounting generally comprises simple ball joints 48 and 50, respectively. Since the embodiment illustrated in FIGS. 1 and 2 includes the link 42, it will be noted that the ball joint 50 is shown in its two parts as separated by the link 42. The link thus preferably includes a partial universal joint 52 at a first end 54 thereof for fitting about a ball 55. At a second end 56 of the link 42, said link 42 generally ends in a simple flat surface whereby the joint formed with the second end 32 of the first hydraulic cylinder 28 is a rigid joint. Further, means, for example a plurality of bolts 58, are generally provided for rigidly attaching the second end 56 of the replaceable link 42 to the first hydraulic cyliner 28.

In the preferred embodiment of the invention, as illustrated, the first end 30 of the first hydraulic cylinder 28 generally comprises the rod end thereof and the second end 32 of the first hydraulic cylinder 28 generally comprises a head end thereof. Further, the link 42 is preferably rigidly attached to the rod end of the first hydraulic cylinder 28 and universally attached adjacent and below the frame 12. In this manner, a pair of conventional hydraulic fluid lines 59, which are connected to the first hydraulic cylinder 28 to activate and operate it, need not be attached or moved when the replaceable link 42 is inserted or removed.

In order to provide sufficient movement of the blade 26, each of the pair of second hydraulic cylinders 36 is generally supported adjacent the frame 12 by link means, for example a bellcrank 60, which is itself rotatably mounted to the main frame 12 via a sidewardly extending support member 61. This serves to allow the pair of second hydraulic cylinders 36 to change in length sufficiently to allow for operation of the blade 26 to a lower range of angles.

FIRST ALTERNATE EMBODIMENT

Figure 3:
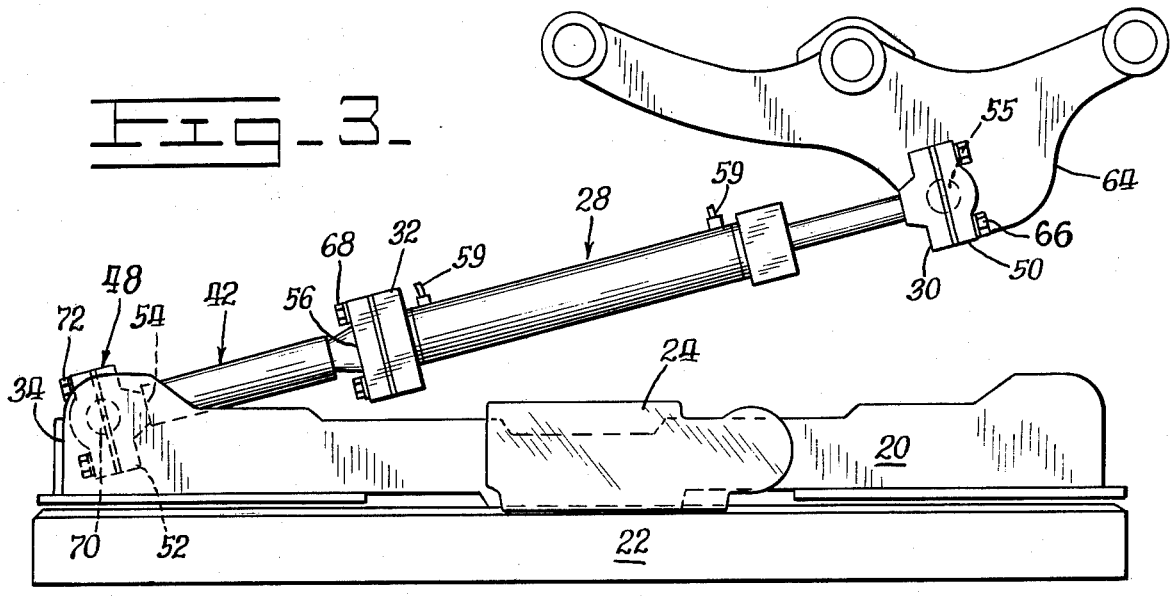
FIG. 3 illustrates a first alternate embodiment of the present invention in a view similar to FIG. 2.

Turning now to FIG. 3 there is illustrated a first alternate embodiment of the present invention wherein the link 42 is positioned between the periphery 34 of the circle drawbar 20 and the second end 32 of the first hydraulic cylinder 28. In this embodiment the first (rod) end 30 of the first hydraulic cylinder 28 is attached universally to the ball 55 and the ball joint 50 is completely formed. The second end 56 of the link 42 attaches directly to the second end 32 of the first hydraulic cylinder 28 to form a rigid joint fastened together by rigid attaching means such as a plurality of bolts 68. The partial universal joint 52 at the first end 54 of the link 42 is attached about a ball 70 to form a universal joint thereabout held together by a plurality of bolts 72.

SECOND ALTERNATE EMBODIMENT

Figure 4:
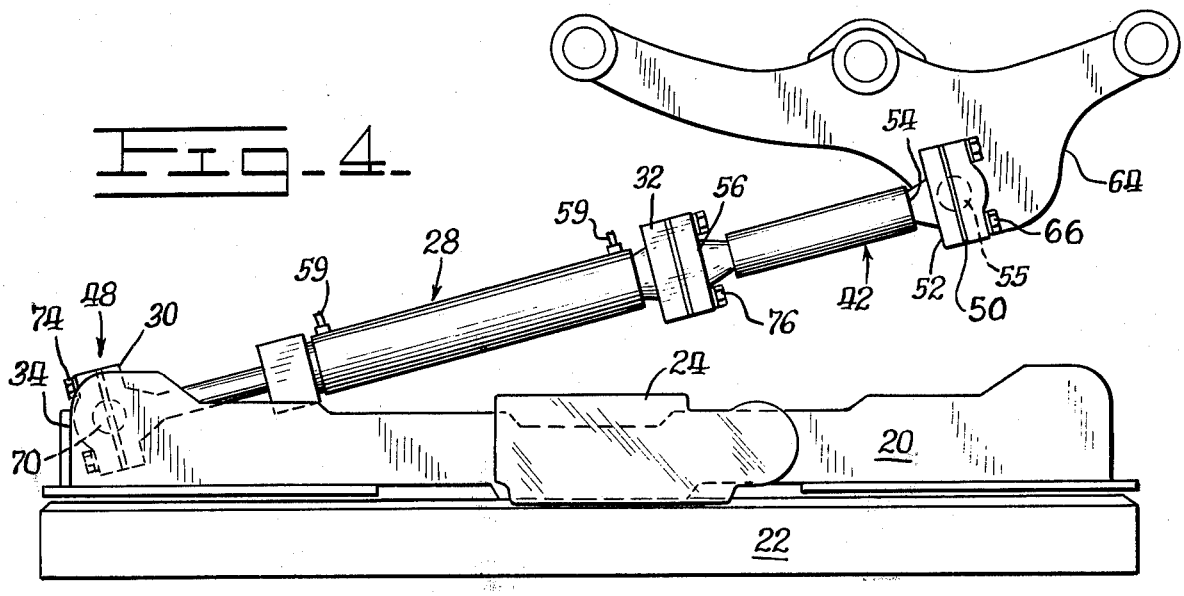
FIG. 4 illustrates a second alternate embodiment of the present invention in a view similar to FIG. 2.

Turning now to FIG. 4 there is illustrated a second alternate embodiment of the present invention wherein the link 42 is positioned as in FIG. 2 but wherein the first hydraulic cylinder 28 is reversed whereby the first (rod) end 30 thereof forms the ball joint 48 adjacent the periphery 34 of the circle drawbar 20 through use of a plurality of bolts 74 and the ball 70. The second (head) end 32 of the first hydraulic cylinder 28 forms a rigid joint with the second end 56 of the link 42 via a plurality of bolts 76 in the same manner as is illustrated in FIG. 2.

THIRD ALTERNATE EMBODIMENT

Figure 5:
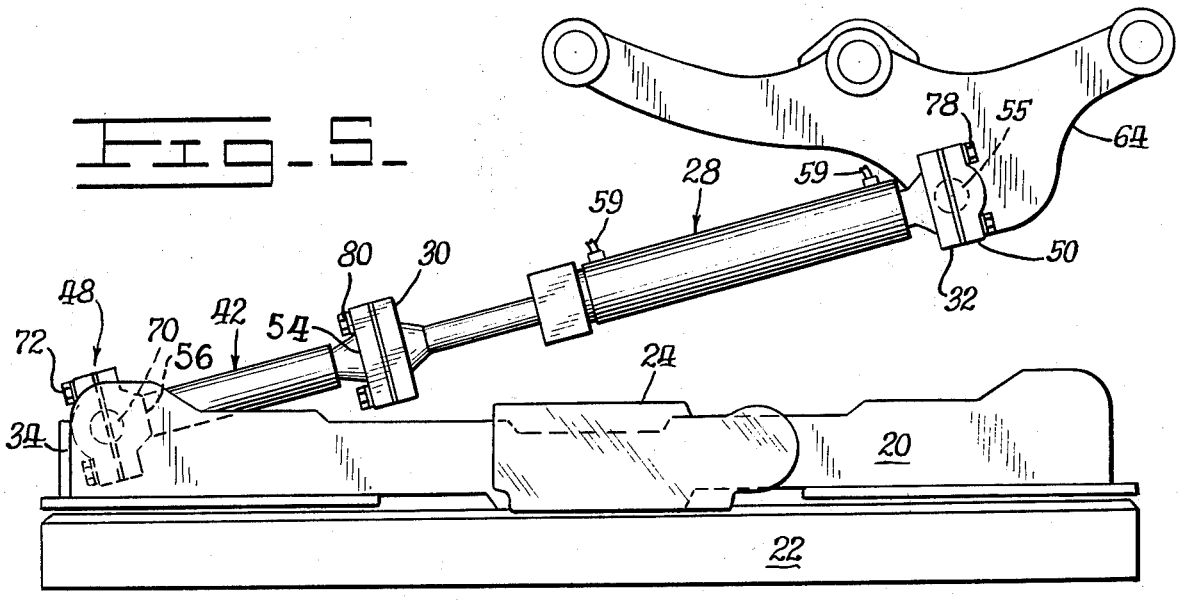
FIG. 5 illustrates a third alternate embodiment of the present invention in a view similar to FIG. 2.

Turning now to FIG. 5 there is illustrated a third alternate embodiment of the present invention wherein the link 42 is positioned as in FIG. 3 but wherein the first hydraulic cylinder 28 is reversed whereby the second (head) end 32 thereof forms the ball joint 50 adjacent crank 64 through use of a plurality of bolts 78 and the ball 55. The first (rod) end 30 of the first hydraulic cylinder 28 forms a rigid joint with the first end 54 of the link 42 through use of a plurality of bolts 80.

It will be apparent that the particular embodiment of the invention utilized will generally depend on the positioning of the hydraulic fluid lines 59 of any particular motor grader 10. Generally, the embodiment used will be chosen such that disconnecting of the fluid lines 59 will not be required.

OPERATION

Operation of each embodiment of the present invention will be obvious from the following explanation of the embodiment of FIGS. 1 and 2.

In operation, the motor grader 10 is utilized in many operations without the replaceable link 42 therein. In such operations the blade 26 cannot be brought to a lower angle from a surface 62 upon which the motor grader 10 operates than a first range of angles "A," as shown in phantom in FIG. 1. When it is desired to cut banks at a lower angle, the rod end of the first hydraulic cylinder 28 is disconnected from the main frame 12 and, more particularly, from linkage means, namely a crank 64 which extends therebelow through removing a plurality of bolts 66 which hold together the universal joint 50 about the ball 55. The link 42 is then inserted with its partial universal joint 52 forming a universal joint adjacent the crank 64. With the replaceable link 42 thus installed and rigidly fastened via the bolts 58 to the first end 30 of the first hydraulic cylinder 28, a second range of angles "B," the second range of angles "B" being smaller than the first range of angles "A," becomes available for the cutting of banks. In this manner, lower angles can be cut.

When it is desired to cut banks on a second side 46 of the frame 12, the link 42 is then removed in a simple and straightforward manner, and the first end 30 of the first hydraulic cylinder 28 is reconnected via the ball joint 50 and thus making use of the ball 55 to the crank 64. Thereafter, with the first hydraulic cylinder 28 being of its normal length, the circle drawbar 20, the circle member 22 and the blade 26 can be moved beneath the main frame 12 from the first side 44 thereof to the second side 46 thereof. As a result of the use of the link 42, banks can be cut on the first side 44 of the frame 12 at any angle within the ranges of angles "A" or "B," and banks can be cut on the second side 26 of the frame 12 at any angle within the first range of angles "A." If the cutting of a bank is desired on the side of the vehicle, which, in FIG. 1, corresponds to the second side 46 of the frame 12, it is only necessary to turn the vehicle 10 around so that it points in an opposite direction to make use of the link 42 for accomplishing this lower angle bank cutting.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to whch the invention pertains and as may be applied to the essential features hereinbefore set forth, and as fall within the scope of the invention and the limits of the appended claims.

What is claimed is:

1. In a motor grader which comprises:

a power unit having a main grader frame extending forwardly therefrom, said frame being supported adjacent its forwardmost end by ground engaging means;

a circle drawbar mounted below said frame intermediate said power unit and said ground engaging means;

a circle member mounted below said circle drawbar;

gear means for rotating said circle member relative to said circle drawbar;

a blade mounted to said circle member and therebelow;

first hydraulic cylinder means rotatably mounted at a first end thereof adjacent said frame and at a second end thereof adjacent a periphery of said circle drawbar; said first cylinder means including a rod which is retractible therein, said first cylinder means with said rod fully retracted therein defining a minimum total length;

second hydraulic cylinder means rotatably mounted adjacent a first end thereof adjacent the periphery of said circle drawbar and adjacent a second end thereof adjacent said frame; and an improvement which includes means for permitting operation of said motor grader at a reduced angle of said blade to a surface being graded, including a detachable link connected in line with said first cylinder means to extend the length thereof, said link having a length such that when said link is connected to said first cylinder means in line therewith and said first cylinder means is at said minimum total length thereof, said first cylinder means and said link are of a collective length which prevents rotation of said blade beneath said frame from a first of said motor grader to a second side thereof, said first cylinder means, when said link is removed therefrom and said first cylinder means is at said minimum total length, allowing said blade to be rotated beneath said frame from said first side to said second side.

2. An improvement in a motor grader as in claim 1, wherein said first cylinder means comprises a first hydraulic cylinder which is universally mounted at said first and second ends thereof adjacent said frame and said periphery of said circle drawbar, said link including a universal joint at a first end thereof and comprising means for rigidly attaching a second end of said link to said first hydraulic cylinder.

3. An improvement in a motor grader as in claim 2, wherein said first end of said first hydraulic cylinder comprises a rod end thereof and said second end of said first hydraulic cylinder comprises a head end thereof and said link is rigidly attached to said rod end and universally attached adjacent and below said frame.

4. An improvement in a motor grader as in claim 3, wherein said second hydraulic means comprises a pair of second hydraulic cylinders, each of which is rotatably mounted to said frame via a crank which extends a spaced distance from said frame.

5. An improvement in a motor grader as in claim 2, wherein said first end of said first hydraulic cylinder comprises a head end thereof and said second end of said first hydraulic cylinder comprises a rod end thereof and said link is rigidly attached to said head end and universally attached adjacent and below said frame.

6. An improvement in a motor grader as in claim 5, wherein said second hydraulic cylinder means comprises a pair of second hydraulic cylinders, each of which is rotatably mounted to said frame via a crank which extends a spaced distance from said frame.

7. An improvement in a motor grader as in claim 2, wherein said first end of said first hydraulic cylinder comprises a rod end thereof and said second end of said first hydraulic cylinder comprises a head end thereof and said link is rigidly attached to said rod end and universally attached adjacent said periphery of said circle drawbar.

8. An improvement in a motor grader as in claim 7, wherein said second hydraulic cylinder means comprises a pair of second hydraulic cylinders, each of which is rotatably mounted to said frame via a crank which extends a spaced distance from said frame.

9. An improvement in a motor grader as in claim 2, wherein said first end of said first hydraulic cylinder comprises a head end thereof and said second end of said first hydraulic cylinder comprises a rod end thereof and said link is rigidly attached to said head end and universally attached adjacent said periphery of said circle drawbar.

10. An improvement in a motor grader as in claim 9, wherein said second hydraulic cylinder means comprises a pair of second hydraulic cylinders, each of which is rotatably mounted to said frame via a crank which extends a spaced distance from said frame.

* * * * *

UNITED STATES PATENT OFFICE

CERTIFICATE OF CORRECTION

Patent No. 4,071,091 Dated January 31, 1978

Inventor(s) CARLISLE S. MORRIS

It is certified that error appears in the above-identified patent and that said Letters Patent are hereby corrected as shown below:

Column 5, line 55, "from a first of said motor" should read -- from a first side of said motor --.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*